US005954135A

United States Patent [19]

Williamson et al.

[11] Patent Number: 5,954,135

[45] Date of Patent: Sep. 21, 1999

[54] METHOD AND APPARATUS FOR ESTABLISHING FLUID COMMUNICATION WITHIN A SUBTERRANEAN WELL

[75] Inventors: Jimmie R. Williamson, Carrollton; Eddie L. Langston, Irving, both of Tex.

[73] Assignee: Halliburton Energy Services, Inc., Dallas, Tex.

[21] Appl. No.: 08/895,676

[22] Filed: Jul. 17, 1997

Related U.S. Application Data

[63] Continuation of application No. 08/785,452, Jan. 17, 1997, abandoned.

[51] Int. Cl.[6] ..... E21B 34/14

[52] U.S. Cl. ..... 166/382; 166/317

[58] Field of Search ..... 166/317, 321, 166/375, 382, 386, 242.1; 137/68.24

[56] References Cited

U.S. PATENT DOCUMENTS

| | | | |
|---|---|---|---|
| 3,882,935 | 5/1975 | Calhoun | 166/323 |
| 4,460,046 | 7/1984 | Pringle | 166/317 |
| 4,512,491 | 4/1985 | DeGood et al. | 137/68.24 |
| 4,944,351 | 7/1990 | Eriksen et al. | 166/376 |
| 5,154,202 | 10/1992 | Hibler, Jr. et al. | 137/68.24 |
| 5,226,483 | 7/1993 | Williamson, Jr. | 166/317 X |
| 5,419,394 | 5/1995 | Jones | 166/242.3 X |

OTHER PUBLICATIONS

Fike Rupture Disc Assemblies, Fike Metal Products Corporation, Blue Springs, MO. 64015 (date unknown).

Otis Surface–Controlled Wireline–Retrievable Safety Valves (date unknown).

Otis Subsurface Safety Accessory Equipment (date unknown).

Fike, Rupture Discs Explosion Vents & Other Pressure Relief Devices (date unknown).

*Primary Examiner*—William Neuder

*Attorney, Agent, or Firm*—Paul I. Herman; John F. Booth

[57] ABSTRACT

A subterranean well assembly and method of installation which uses a selectively rupturable flow control device to initially block flow and after rupture to allow flow therethrough. The selectively rupturable device is eccentric, in that, it withstands higher pressures without rupture in a flow direction which ruptures when lower pressures are applied to the device in the opposite direction. The rupturable device is installed in a subterranean well in the flow path between the production tubing string and casing.

48 Claims, 3 Drawing Sheets

METHOD AND APPARATUS FOR ESTABLISHING FLUID COMMUNICATION WITHIN A SUBTERRANEAN WELL

This application is a continuation of U.S. application Ser. No. 08/785,452, filed Jan. 17, 1997, now abandoned entitled "Method and Apparatus For Establishing Fluid Communication Within A Subterranean Well".

FIELD OF THE INVENTION

The invention relates to downhole tools for subterranean wells and in particular to methods and apparatus for establishing fluid communication in a subterranean well.

BACKGROUND OF THE INVENTION

It is common practice in the completion of subterranean wells, such as oil and gas production wells, to include subsurface well tools and devices. These devices can be remotely controlled or operated via a small diameter conduit or control line. One common example of a downhole tool of this type is a subsurface safety valve. Safety valves are used to shut off the flow of fluid in the well production tubing. Subsurface safety valves can be controlled or operated in response to fluid pressure conducted through a control line to the valve from the well surface. A controller is located at the well surface and is typically designed to respond to emergency conditions, such as fire, broken flow lines, oil spills, etc., to actuate the safety valve to shut off flow from the well.

In a typical environment, a tubing mounted safety valve is made up in the tubing string and installed in the well tubing with a hydraulic control line extending to the surface along the outside of the tubing string. In cased wells the control lines are located in the space formed between the tubing and casing. Examples of tubing retrieval safety valves are described in U.S. Pat. No. 4,945,993 or can be purchased from the Halliburton Company, 2601 Beltline Road, Carrollton, Tex. 75006 as the series 10 W flapper-type valves. The patents listed herein are incorporated by reference for all purposes in this application.

In environments where a well is anticipated to have a long life, provision is made for inserting a second subsurface safety valve in the well at a later time. To accomplish this, typically, a safety valve landing nipple is placed in the well tubing at the time of installation of the tubing retrieval safety valve. A landing nipple is a device that is designed to receive a downhole tool such as a surface controlled retrievable safety valve. Typically, landing nipples for safety valves have a structure mating with a lock mandrel for mounting the safety valve in place have and a port or passageway extending through the wall of the nipple connected to a hydraulic control line extending to the surface. The control line connected to the landing nipple can be used at a later date to control a safety valve or other device mounted in the nipple. If the primary well tubing safety valve becomes unreliable a second safety valve, can be installed in the landing nipple. Typically, safety valves of this type are installed using wireline, pump down, or other means as are well known in the industry. Retrievable landing nipples, lock mandrels, and safety valves therefor are shown in U.S. Pat. No. 5,323,859, and devices of this type can be purchased from Halliburton Company as XXO, FRQ, and KRQ landing nipples.

It has been found that in wells where there is a long time interval between initial installation of the landing nipple and the ultimate installation of the safety valve that the hydraulic line connected thereto can become irreversibly clogged with well fluids or well treatment fluids that have moved into the hydraulic control line through the port in the landing nipple. In those situations where the hydraulic line is clogged, an expensive process to install a new safety valve must be performed, and the well must be shut down during the process. Similar contamination and plugging problems with open control lines are present in other downhole devices such as landing nipples for sliding doors and the like.

SUMMARY OF THE INVENTION

In accordance with the methods and apparatus of the invention, a rupturable flow control device is placed in the control line adjacent to the landing nipple or other downhole device. Preferably, this flow control device is located in series between the landing nipple and hydraulic control line before the landing nipple has been installed in the well. One type of rupturable valve elements are known as "rupture disc assemblies" from FIKE Metal Products Corporation, Blue Springs, Mo. 64015 USA. These devices contain a diaphragm disc in the flow path designed to rupture at a specified pressure. The suppliers of these devices allow customers to order these devices by specifying burst pressure, inlet or outlet size, and material requirements. For example, the FIKE's devices are available with burst pressures of 12,000 psi at 800 F for soldered units and at higher pressures and temperatures for welded units. There are other sources of supply of rupture disc valve elements, such as, BS&B Rupture Discs. For purposes of this patent these devices will be generally referred to as rupturable flow control devices of the type using a rupture disc valve element.

The flow control device of the present invention is designed to be a unidirectional in the sense that will rupture if the pressure differential across the device in one direction exceeds a specified amount but will not rupture if the pressure differential in the opposite direction reaches that amount. For purposes of description a device of this type will be identified as an eccentric flow control device.

According to the present invention a rupturable valve element is mounted in the flow control device such that the element is protected from rupture when operating pressures in the well exceed those in the hydraulic control line. On the other hand, the eccentric rupturable valve element is designed such that when pressure in the hydraulic control line is raised sufficiently above that in the well the valve element will rupture or fail irreversibly opening the control line.

For ease of installation, the flow control device containing the rupturable valve element is placed in a fitting which is connected at one end to the landing nipple and the other end to the hydraulic control line.

In this manner, a well can be completed with a landing nipple in the tubing string having a rupturable valve element blocking the flow of well fluids into the associated hydraulic control line. When in the life of the well it is necessary to install a downhole tool in the landing nipple, pressure in the hydraulic control line is raised to the point where the valve element ruptures and is flushed through the port in the landing nipple. Thereafter, a tool such as a safety valve can be installed in the landing nipple and operated via the control line.

The eccentric characteristic of the rupturable valve element in the flow control device also provides additional protection against inadvertent rupture or failure by reason of high well pressures.

The advantages of the present invention are that it allows a hydraulic control line to be placed in communication with a downhole device and be closed off from undesirable effects of well fluids and well treatment fluids until the hydraulic control line is needed. The eccentric aspects of the rupturable valve element are such that it protects against damage from downhole pressures and allows the rupturable valve element to be used in ordinary well environments. In addition, the valve element can be ruptured by raising the pressure in the hydraulic control line which also allows for flushing of the rupturable valve element from the system before installation of a well tool in the landing nipple.

It is also to be understood that the present invention has application to other types of landing nipples than those used for safety valves, such as, sliding side doors and the like.

Other advantages of this invention will be readily apparent to those skilled in the art from the following detailed description taken in conjunction with the annexed sheets of drawings.

BRIEF DESCRIPTION OF THE DRAWINGS

The accompanying drawings are incorporated into and form a part of the specification to illustrate an example of the present inventions. These drawings together with the description serve to explain the principles of the inventions. The drawings are only for purposes of illustrating preferred or alternative examples of how the inventions can be made and used and are not to be construed as limiting the inventions to only the illustrated and described examples. The various advantages and features of the present inventions will be apparent from a consideration of the drawings in which.

DESCRIPTION OF THE PREFERRED EMBODIMENT

Figure 1:
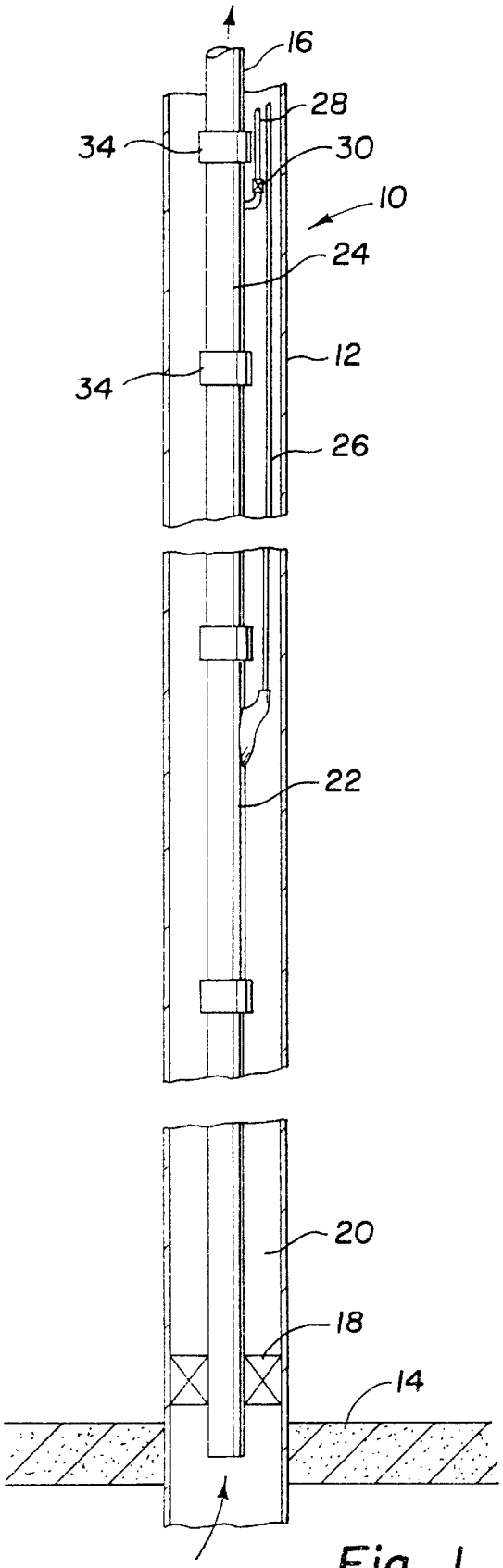
FIG. 1 is a vertical schematic cross section view of an exemplary subterranean well installation utilizing the methods and apparatus of the present inventions.

The present inventions will be described by referring to the drawings of apparatus and methods showing an example of how the inventions can be made and used. In these drawings reference characters are used throughout the several views to indicate like or corresponding parts. In FIG. 1, one example installation of how the present invention can be used in the downhole portion of a subterranean well is shown. Well 10 is shown having a casing 1 2 extending to a producing formation 14. Although not shown, it is to be understood that the casing 12 extends to the surface. Mounted within the interior of the well casing 12 is a production tubing string 16 which, likewise, extends from the surface to a point adjacent to formation 14. A packer 18 is typically utilized to close the annulus (annular space) 20 formed between the exterior of the production string 16 and the interior of the casing. For purpose of illustration, the production tubing string 16 is shown including a tubing retrievable safety valve 22 and a landing nipple 24. Since valve 22 is illustrated as being of a tubing retrievable type, it is made up or connected in the production tubing string 16 as it is lowered into the well. A typical tubing retrievable valve can consist of a safety valve designed to close off the flow through tubing string 16 upon the occurrence of a preselected event as is well known in the industry. Valve 22 is of the type which utilizes a hydraulic control line 26 to, likewise, extend to the well surface.

Landing nipple 24 is also made up in the tubing string 16 as it is assembled and lowered into the well. Landing nipple 24 is of the type which can receive a downhole tool, such as a valve therein. Landing nipple is a generic term used in the oil industry to describe a hollow receptacle which is made up in the tubing string and in which the well tool can be installed and/or removed as desired. For purposes of description the inventions have been described by referring to a landing nipple; however, the inventions could be used in any device containing a control line receptacle such as, landing nipple, safety valve, subseal test tree, or any other hydraulically actuated downhole device. Landing nipple 24 is shown having a hydraulic control line 28 connected thereto. Hydraulic control line 28 extends to the surface and is present for use in operating a tool set or mounted within the landing nipple 24.

Although not shown, as is well understood in the industry, the well surface will typically have a series of valves and control mechanisms for receiving products produced through the well string and for supplying hydraulic pressure to the control lines 26 and 28. A typical example is shown as described in U.S. Pat. No. 5,323,859 which is incorporated herein by reference for all purposes.

In accordance with the present invention, a flow control device 30 is connected between the landing nipple 24 and control line 28. As will be described in detail, this flow control device 30 is of the type which is normally closed and prevents flow between the landing nipple 24 and control line 28. The flow control device 30 is designed to withstand internal pressures within the production tubing string 16 and is designed to fail or rupture or open the fluid pathway between the landing nipple 24 and hydraulic control line 28 when pressure is applied through the hydraulic control line 28 above a specified limit.

In accordance with the present invention, once a well 10 is assembled and the casing is set, production string is made up and installed in the well. In the example shown in FIG. 1, the production string includes a downhole tubing retrievable safety valve 22 which is connected through hydraulic lines 26. Hydraulic line 26 is assembled at the same time and is lowered into the well with the tubing string. In the FIG. 1 embodiment, the tubing string 16 is also made up or assembled at the surface to include the landing nipple 24 having the device 30 of the present invention connected thereto and hydraulic control line 28 extending from the device 30 to the surface.

Once the tubing string is installed, production from the well is through the production tubing string 16 to the surface. Valve 22 remains in the open position unless and until it is closed via the hydraulic control line 26. Should the safety valve 22 lose its integrity, a second safety valve can be placed in the well through the tubing string and landed or mounted within landing nipple 24. Prior to installing the valve in the landing nipple 24, the pressure in hydraulic line 28 is increased to a sufficient value to rupture and open device 30 flushing the passageway of debris prior to setting the valve. After the valve is set, hydraulic control line 28 is used to operate the valve or the device seated therein.

Figure 2:
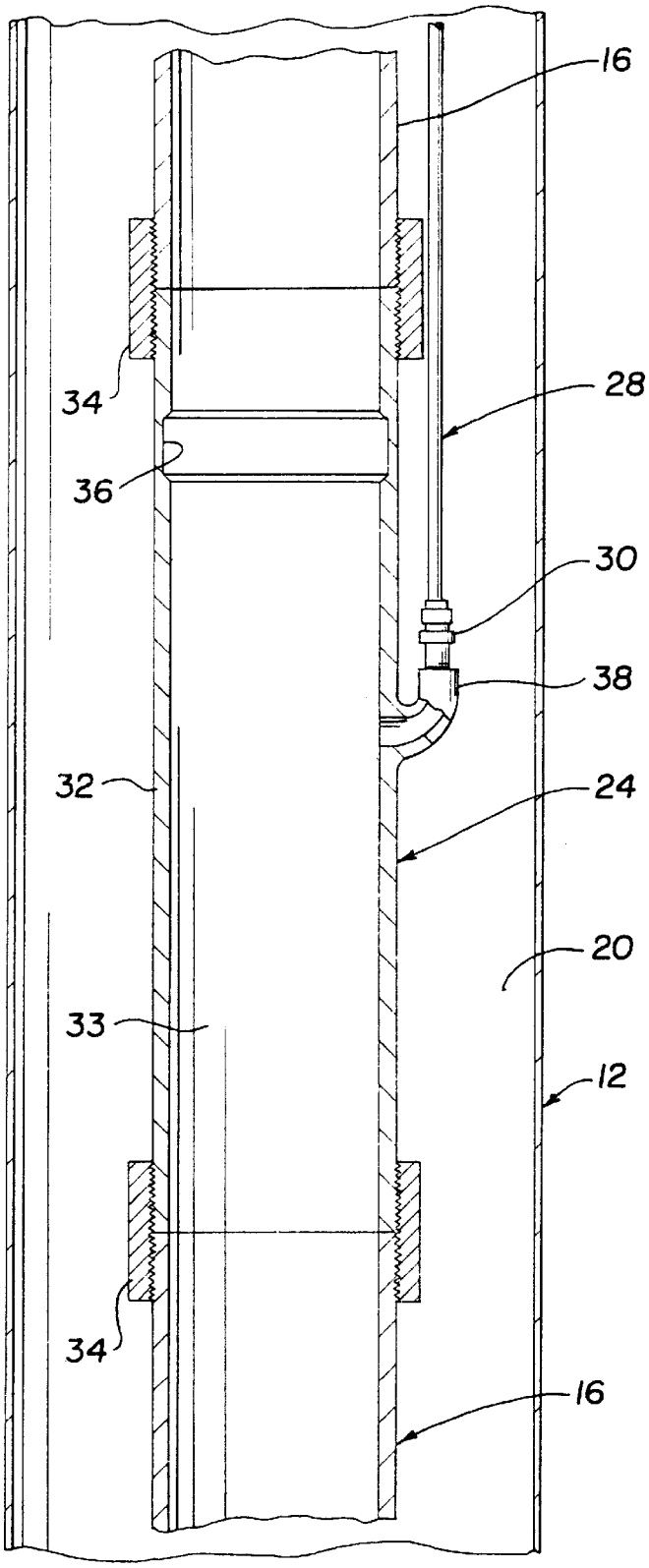
FIG. 2 is a vertical cross section view of a schematic of a typical well landing nipple assembled in accordance with the present invention.

Turning to FIG. 2, cross sectional schematic view of a landing nipple 24 installed in casing 12 is shown. Landing nipple 24 has a hollow body 32 connected in the tubing string 16 by threaded collars 34. Body 32 has a chamber 33 formed therein which includes a landing or locking groove 36 formed in the interior wall of chamber 33. It is this locking groove 36 that is used to engage a locking mandrel (not shown) to mount a safety valve or other device within the landing nipple 24. A port or passageway 38 in the wall of nipple 24 is in fluid communication with chamber 33 and is connected to device 30. Device 30 is, in turn, connected to hydraulic control line 28 as shown. As can be seen in this figure, well fluids moving through the tubing string 16 and chamber 33 are in direct communication with the port 38. Without the presence of device 30, these fluids can enter the hydraulic control line and corrode, plug, or otherwise deteriorate the same. In a well which has a long productive life, a well designed and manufactured subsurface safety valve can function for years or even decades before its integrity falls into question. Thus, in nipples without device 30, the hydraulic control line 28 could be exposed to well fluids for years or even decades.

Figure 3:
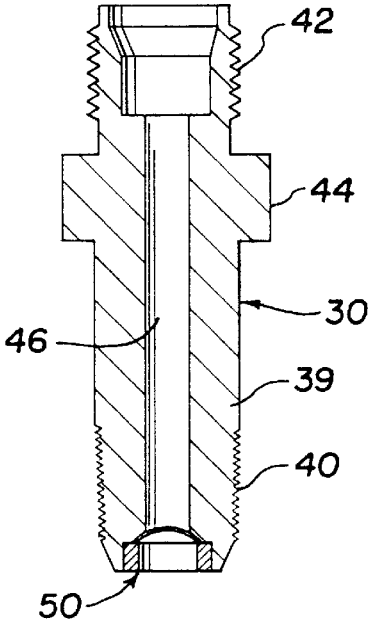
FIG. 3 is a sectional view showing one embodiment of the flow control device shown in FIG. 2.

In FIG. 3 flow control device 30 is shown in cross section. In this embodiment device 30 has a body 39 with male threads 40 of the size to connect with female threads (not shown) formed in port 38 of landing nipple 24. In this embodiment it is preferable that the threads 40 be pipe threads sealing with the threads formed in the nipple 24. Even though a threaded engagement is shown, it is to be appreciated that device 30 could be welded or otherwise connected by use of O-rings, packing, or the like to form a fluid tight connection to the landing nipple. Male threads 42 are also formed in the opposite end of body 39 of device 30. These male threads are for connection to a hydraulic fitting on the hydraulic control line 28. A central passageway 46 extends through the body 39 of the device 30. A rupturable valve disc assembly 50 is installed in the body 39 adjacent the threaded end 40 to close the central passageway 46.

Figure 4:
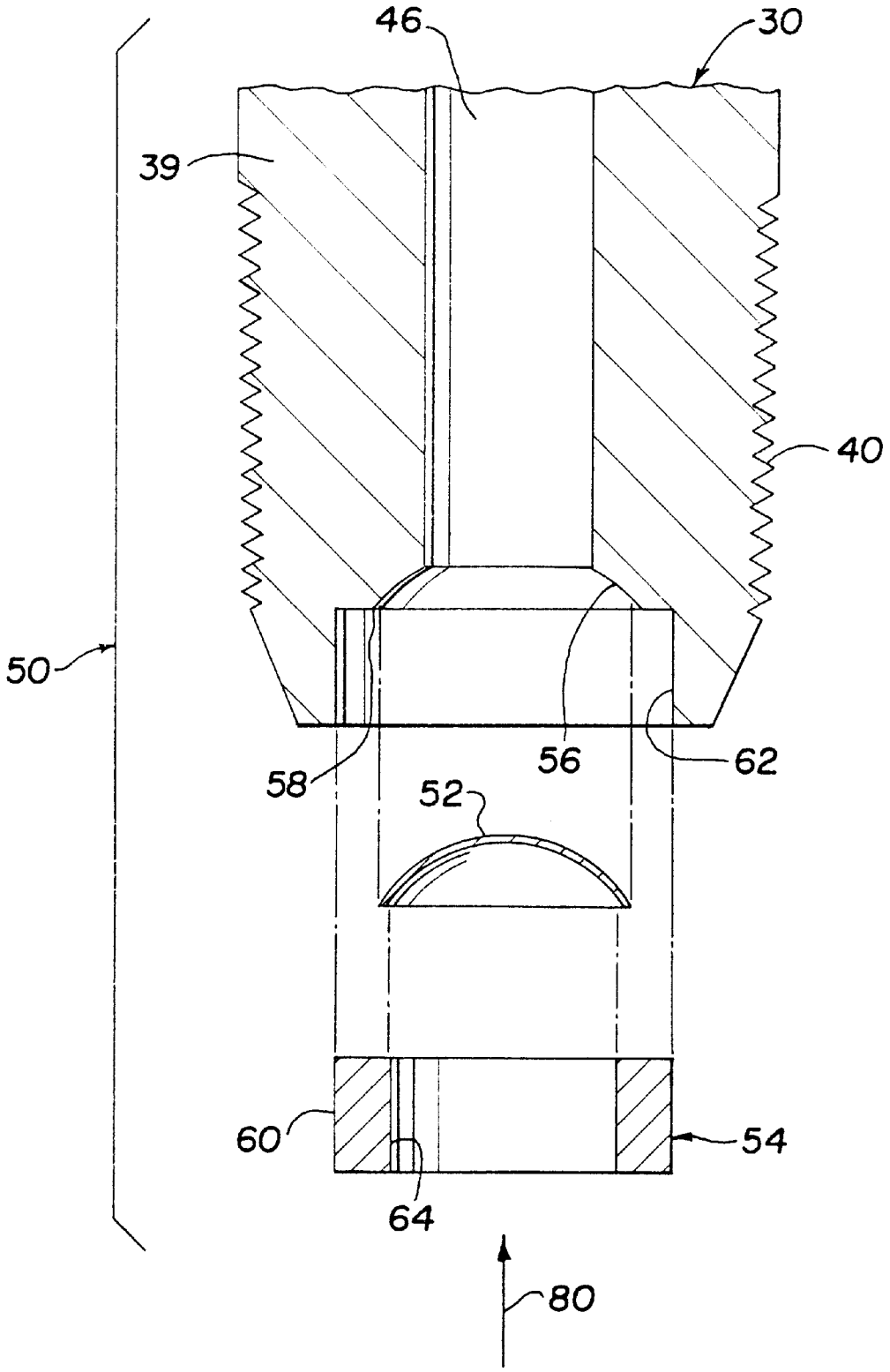
FIG. 4 is an enlarged exploded view of the valve element of the flow control device illustrated in FIG. 3.

In FIG. 4 the details of this rupturable valve assembly 50 is shown. The assembly 50 consists of a curved disc 52 and backup mounting ring 54. In the embodiment shown the disc 52 forms a valve element and is concaved in shape in the direction of the landing nipple. The body 39 has a corresponding concaved annular surface 56 therein of the size and shape to mate with disc 52. Although the disc is shown in an exploded view in FIG. 4, when properly assembled the disc is welded in place along the maximum diameter edge 58 of the surface 56. In the embodiment shown ring 54 has an outer cylindrical surface 60 of the size and shape to be press fit in counterbore 62 in body 39. Ring 54 has an axial depth corresponding to the depth of the counterbore 62 and is installed in a press fit therein. Ring 54 has an interior wall defining a cylindrical axially extending central passageway. In this embodiment the chamber or passageway formed by the interior wall 64 is slightly smaller than the disc 52 to assist in retaining the disc in the assembly 50. In the embodiment shown the diameter of the surface forming wall 64 is less than the diameter of the edge 58.

When a positive pressure differential is applied across the disc 52 in the direction of arrow A, surface 56 contacts and supports the disc surface giving it added strength in the direction of arrow A. In addition, the concave shape gives strength to the disc 52. If the positive pressure differential is reversed and applied from the passageway 46 across disc 52, surface 56 does not provide support and burst strength of the disc 52 in this direction is less. In this manner, the flow control device is eccentric in its performance.

It is preferred that the geometry and thickness of the disc be selected such that ordinary positive well pressures in the direction of the arrow 80 will not cause the disc to rupture or fail. The geometry and thickness of the same disc can also be designed such that when the positive pressure in passageway 46 is increased sufficiently above well pressure but within attainable hydraulic control pressures disc 52 will rupture and the flow of hydraulic fluid will flush the disc through the chamber formed by wall 64 and, in turn, through the port 38 and into the production tubing string 16. In this manner the flow control device 30 performs the function of sealing the hydraulic control line 28 from well fluids flowing through the landing nipple 24 but, at a later date, a flow control device 30 can be opened to allow hydraulic line 28 to be used to control a device set in the landing nipple 24.

The flow control device 30 is attached to the landing nipple 24 at the well surface prior to its installation. Hydraulic line 28 is, likewise, connected to the flow control device as the tubing string 16 is installed in the well. When it becomes necessary to bring the landing nipple to life and open the hydraulic control line connected to the landing nipple, the pressure in hydraulic control line 28 is increased to exceed the burst point of the flow control device 30 thus establishing hydraulic communication through the line 28 and port 38. Thereafter, the downhole tool, such as a safety valve, can be set in the landing nipple 24 and operated by use of the hydraulic control line 28.

It is to be appreciated that the device 30 could be formed in the landing nipple within the port 38 without departing from the spirit and scope of the invention. In addition, the flow control device 30 could be placed in the hydraulic line 28 in a point adjacent to the landing nipple. It is to be appreciated that it is desirable to have the device 30 as close as possible to port 38, thus, providing as much protection as possible from the well fluids. However, the flow control device 30 and its assembly in the system could still have substantial advantages if placed adjacent to the landing nipple in the hydraulic line a short distance away.

It is also to be appreciated that the well control device of the present invention could be utilized at ports in devices other than landing nipples even though no hydraulic line is connected on the annulus side of the flow control device. In these installations, the pressure in the annulus could be increased above that of the well string to rupture the flow control device and establish communication between the annulus and the tubing string if desired.

The embodiments shown and described above are only exemplary. Many details are found in the art, such as, the construction of the various well tools, landing nipples, safety valve, lock mandrels, sliding side door nipples, sliding side door tools, and the like and are incorporated herein by reference to the patents listed herein. Therefore, many such details are neither shown nor described. It is not claimed that all of the details, parts, elements, or steps described and shown were invented herein. Even though numerous characteristics and advantages of the present inventions have been set forth in the foregoing description, together with the details of the structure and function of the inventions, the disclosure is illustrative only, and changes may be made in the detail especially in matters of shape, size, and arrangement of the parts within principles of the invention to the full extent indicated by the broad general meaning of the terms used in the attached claims.

The restrictive description and drawings of the specific examples described above do not point out what an infringement of this patent would be but are to provide at least one explanation of how to make and use the inventions. The limits of the inventions and the bounds of the patent protection are measured by and defined in the following claims:

We claim:

1. A method of installing a landing nipple for a well tool in a tubing string of a subterranean well, the landing nipple being of the type for connection to a fluid control line, comprising:

installing the landing nipple in the tubing string, the landing nipple having a port in the wall thereof for fluid communication with the control line;

connecting the control line to the landing nipple port;

connecting a normally closed rupturable eccentric flow control device in fluid communication with the control line and landing nipple port at a location adjacent to the landing nipple with the eccentric flow control device blocking flow through the control line and with the eccentric flow control device having a higher bursting pressure across the device in the flow direction of the well than in the flow direction of the fluid control line;

positioning the tubing string and landing nipple in the well;

connecting the control line to a pressure source; and thereafter increasing the pressure in the control line at the flow control device to rupture the device and open flow between the control line and landing nipple port.

2. The method of claim 1 wherein the step of connecting an eccentric flow control device comprises connecting the device to block flow between the landing nipple and control line.

3. The method of claim 1 wherein connecting an eccentric flow control device comprises connecting the flow control device to the landing nipple and the control line.

4. The method of claim 1 comprising the additional step of installing a well tool in the landing nipple after the step of increasing pressure in the control line.

5. A tubing string assembly for a subterranean well having a length of tubing, a hydraulically controlled landing nipple connected din the tubing string, a hydraulic control line in the well for supplying hydraulic fluid to the landing nipple and the improvement which comprises:

an eccentric flow control device connected in the control line adjacent the landing nipple to control flow between the landing nipple and control line, a rupturable diaphragm in the device blocking flow through the device wherein the diaphragm is designed to rupture when pressure across the valve element exceeds a selected value, wherein the diaphragm has a burst strength which is higher in one direction.

6. Tubing string assembly of claim 5 wherein the device is located between the landing nipple and the control line.

7. Tubing string of claim 5 wherein the device is directly connected to the landing nipple and the hydraulic control line.

8. A tubing string of claim 5 wherein the device is located in series between the landing nipple and the control line.

9. A tubing string assembly of claim 5 wherein the device is located in the tubing string axially spaced away from the landing nipple.

10. A tubing string assembly according to claim 6 wherein the landing nipple is a safety valve landing nipple.

11. A tubing string assembly of claim 5 wherein the landing nipple is a side door landing nipple.

12. A tubing string assembly of claim 5 additionally comprising a tubing retrievable valve connected in the tubing string.

13. A tubing string assembly according to claim 12 wherein the tubing retrievable valve is a safety valve.

14. A tubing string assembly according to claim 12 wherein the tubing retrievable valve is a side door.

15. A tubing string assembly according to claim 5 wherein the device comprises a body having a flow passageway therethrough and a normally closed diaphragm valve element on the body blocking the passageway.

16. A tubing string assembly according to claim 15 wherein the diaphragm is a metal disc.

17. A tubing string assembly of claim 5 wherein the device is located in the tubing string axially spaced away from the receptacle.

18. A hydraulic control fluid communication nipple assembly for connecting in well tubing of a subterranean well and for connection to a control line extending to the well surface comprising:

a body having an elongated bore therethrough;

a fluid passageway in the body adapted to be connected to the control line for receiving hydraulic control fluid; and an eccentric flow control device connected to the fluid passageway for controlling flow through the passageway, the eccentric flow control device comprising a body with a passageway therethrough in fluid communication with the fluid passageway in the body, a rupturable valve element mounted in the body to block flow through the device, the rupturable valve element having eccentric burst characteristics.

19. The nipple of claim 18 additionally comprising surfaces in the body of said flow control device contacting and supporting one side of the valve element.

20. The nipple of claim 18 wherein the rupturable valve element ruptures at a lower pressure differential applied across the valve element in one direction and at a higher pressure differential applied across the valve element in the reverse direction.

21. A method of installing a device including a control line receptacle in a tubing string of a subterranean well, the control line receptacle being of the type for connection to a fluid control line, comprising:

installing in the tubing string the control line receptacle of the type having a port in the wall thereof for fluid communication with the control line; connecting the control line to the control line receptacle port; connecting a normally closed rupturable flow control device in fluid communication with the control line and control line receptacle port at a location adjacent to the control line receptacle with the device blocking flow through the control line with the eccentric flow control device having a higher rupture pressure across the device in one direction;

positioning the tubing string and control line receptacle in the well;

connecting the control line to a pressure source; and thereafter increasing the pressure in the control line at the flow control device to rupture the device and open flow between the control line and control line receptacle port.

22. The method of claim 21 wherein the step of connecting an eccentric rupturable flow control device comprises connecting a device to block flow between the control line receptacle and control line.

23. The method of claim 21 wherein the step of connecting an eccentric rupturable flow control device comprises connecting an eccentric flow control device to block flow between the control receptacle and control line with the eccentric flow control device having a higher burst pressure across the device in the flow direction of the well than in the flow direction of the fluid control line.

24. The method of claim 21 wherein connecting an eccentric rupturable flow control device comprises connecting the flow control device to the control line receptacle and the control line.

25. The method of claim 21 comprising the additional step of installing a well tool in the control line receptacle after the step of increasing pressure in the control line.

26. A tubing string assembly for a subterranean well having a length of tubing, a hydraulically controlled receptacle connected in the tubing string, a hydraulic control line in the well for supplying hydraulic fluid to the receptacle and the improvement which comprises:

an eccentric flow control device connected in the control line adjacent the receptacle to control flow between the receptacle and control line, a rupturable diaphragm in the device blocking flow through the device wherein the diaphragm is designed to rupture when pressure across the valve element in one direction exceeds a selected value and is designed not to rupture when pressure across the valve element in the opposite direction exceeds the selected value.

27. Tubing string assembly of claim 26 wherein the device is located between the receptacle and the control line.

28. Tubing string of claim 26 wherein the device is directly connected to the receptacle and the hydraulic control line.

29. A tubing string of claim 26 wherein the device is located in series between the receptacle and the control line.

30. A tubing string assembly according to claim 22 wherein the receptacle is a safety valve landing nipple.

31. A tubing string assembly of claim 26 wherein the receptacle is a side door landing nipple.

32. A tubing string assembly of claim 26 additionally comprising a tubing retrievable valve connected in the tubing string.

33. A tubing string assembly according to claim 32 wherein the tubing retrievable valve is a safety valve.

34. A tubing string assembly according to claim 32 wherein the tubing retrievable valve is a side door.

35. A tubing string assembly according to claim 26 wherein the device comprises a body having a flow passageway therethrough and a normally closed diaphragm valve element on the body blocking the passageway.

36. A tubing string assembly according to claim 35 wherein the diaphragm is rupturable.

37. A tubing string assembly according to claim 35 wherein the diaphragm is a metal disc.

38. A tubing string assembly according to claim 35 wherein the diaphragm has a burst strength which is higher in one direction.

39. A hydraulic control fluid communication device assembly for connecting in well tubing of a subterranean and for connection to a control line extending to the well surface well comprising:

a body having an elongated bore therethrough;

a fluid passageway in the body adapted to be connected to the control line for receiving hydraulic control fluid; and a flow control device connected to the fluid passageway for controlling flow through the passageway, the flow control device comprising a body with a passageway therethrough in fluid communication with the fluid passageway in the body, a rupturable valve element mounted in the body to block flow through the device, the rupturable valve element having eccentric burst characteristics.

40. The device of claim 39 additionally comprising surfaces in the body of said flow control device contacting and supporting one side of the valve element.

41. The assembly of claim 39 wherein the rupturable valve element having eccentric characteristics has a burst strength which is higher in one direction.

42. The assembly of 39 wherein the rupturable valve element has a higher burst pressure across the element in the flow direction of the well than in the flow direction of the hydraulic control fluid.

43. The assembly of claim 39 wherein the rupturable valve element ruptures at a lower pressure differential applied across the element in one direction and a higher pressure differential applied in a reverse direction.

44. The assembly of claim 39 wherein the rupturable valve element is a diaphragm.

45. The assembly of claim 44 wherein the diaphragm is a metal disc.

46. The assembly of claim 39 wherein the diaphragm is a curved disc.

47. The assembly of claim 40 wherein the rupturable valve element is a diaphragm, the diaphragm concave in shape.

48. The assembly of claim 47 wherein the surfaces of the body of the flow control devices are concave in shape corresponding to the concave shape of the diaphragm.

* * * * *